US008939256B2

(12) United States Patent
Nielsen

(10) Patent No.: US 8,939,256 B2
(45) Date of Patent: Jan. 27, 2015

(54) COLLAPSIBLE LADDER

(75) Inventor: Otto Martinus Nielsen, Hørsholm (DK)

(73) Assignee: Patentselskabet af 10. december 2010 ApS, Roskilde (DK)

( * ) Notice: Subject to any disclaimer, the term of this patent is extended or adjusted under 35 U.S.C. 154(b) by 0 days.

(21) Appl. No.: 13/982,947

(22) PCT Filed: Jan. 30, 2012

(86) PCT No.: PCT/EP2012/051411
§ 371 (c)(1),
(2), (4) Date: Oct. 9, 2013

(87) PCT Pub. No.: WO2012/104238
PCT Pub. Date: Aug. 9, 2012

(65) Prior Publication Data

US 2014/0318893 A1 Oct. 30, 2014

(30) Foreign Application Priority Data

Feb. 2, 2011 (DK) ..... 2011 00068

(51) Int. Cl.
*E06C 1/12* (2006.01)
*E06C 7/04* (2006.01)

(52) U.S. Cl.
CPC .. *E06C 1/125* (2013.01); *E06C 7/04* (2013.01)
USPC ..... 182/195

(58) Field of Classification Search
CPC ..... E06C 1/125
USPC ..... 182/195
See application file for complete search history.

(56) References Cited

U.S. PATENT DOCUMENTS 5,495,915 A * 3/1996 Weston et al. ..... 182/195
7,967,110 B2 * 6/2011 Parker ..... 182/77

FOREIGN PATENT DOCUMENTS

CN 200 985 737 Y 12/2007
CN 201 495 980 U 6/2010

(Continued)

OTHER PUBLICATIONS

International Search Report from International Application No. PCT/EP2012/051411, mailed May 21, 2012.

*Primary Examiner* — Alvin Chin-Shue
(74) *Attorney, Agent, or Firm* — Baker & Hostetler LLP

(57) ABSTRACT

There is provided a collapsible ladder having several collapsible ladder sections, where each or at least part of the ladder sections comprises two hollow ladder bars arranged parallel to each other and interconnected at an upper end by a rung, and where each collapsible ladder section is telescopically inserted into a lower ladder section. Each ladder bar of a collapsible ladder section has a locking hole adjacent the lower end part of the ladder bar and an extension below the locking hole, and retaining mechanisms are provided in at least part of the rungs for locking the collapsible ladder sections relative to one another when the collapsible ladder sections are extended. Each of or part of the retaining mechanisms comprises a locking pin, which can be brought into an extended and locked position in order to engage a corresponding locking hole provided in the ladder bar of a ladder section positioned there above, and a release part for bringing the locking pin into a retracted and un-locked position. At least part of the rungs holding a retaining mechanism with a locking pin and a release part have spacers provided at the bottom, where at least part of said spacers have a release actuator with a bottom part extending below the spacer when the ladder section above the rung is locked in the extended position. The release actuator engages the release part of a retaining mechanism of the rung and is arranged to activate the release part when the bottom part of the release actuator is moved upwards through the spacer thereby bringing the locking pin into the un-locked position.

18 Claims, 5 Drawing Sheets

(56) References Cited

FOREIGN PATENT DOCUMENTS

| | | | | |
|---|---|---|---|---|
| CN | 201 502 312 | U | | 6/2010 |
| CN | 201 991 430 | U | | 9/2011 |
| DE | 19530452 | A1 | * | 2/1997 |
| EP | 2370656 | A1 | * | 10/2011 |
| JP | 08 093371 | A | | 4/1996 |
| WO | 2010/060429 | A1 | | 6/2010 |

* cited by examiner

Fig. 4b
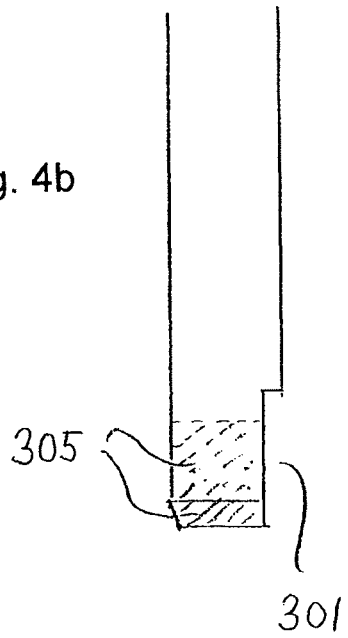
Fig. 4a
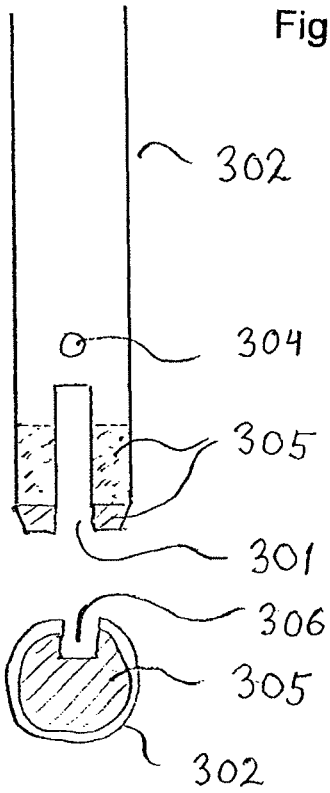
Fig. 4c

Fig. 5a
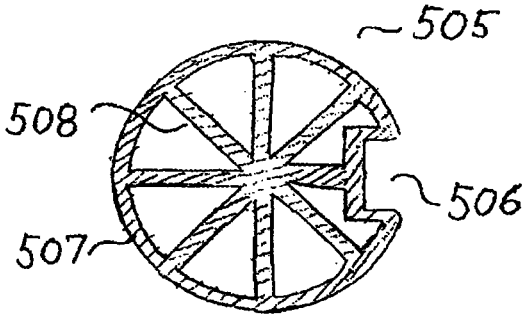
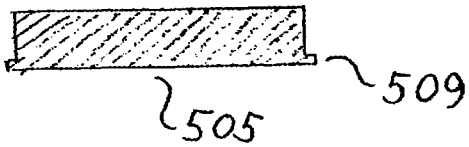
Fig. 5b

COLLAPSIBLE LADDER

CROSS-REFERENCE TO RELATED APPLICATIONS

This application is a national stage entry of PCT/EP2012/051411, filed on Jan. 30, 2012, which claims priority to DK Application No. PA201100068, filed Feb. 2, 2011, each of the disclosures of which are hereby incorporated by reference in their entirety.

FIELD OF INVENTION

The present invention relates to a collapsible ladder of the type comprising U-shaped ladder sections being telescopically inserted in each other.

BACKGROUND OF THE INVENTION

Ladders having collapsible and expandable ladder sections are used in order to make the ladder smaller for storage and transport purposes.

In the European patent EP-B1-0 527 766 a collapsible ladder is described comprising ladder bars divided into sections interconnected by rungs. In each ladder section is provided retaining or locking mechanisms, designed to automatically release the upper ladder sections, when a rung reaches a lower rung. This means, that subsequent to the release of the lowermost ladder section, the following ladder sections are automatically released, whereby the ladder collapses. However, when collapsing the ladder, the rungs are collapsing on top of each other, thereby generating a safety problem for the users hands and fingers.

Thus, there is a need for a collapsible ladder, which allows the ladder sections to be automatically released by release of the lowermost ladder section, but which provides safety spacers between the rungs to avoid injuries of a users hands or fingers.

SUMMARY OF THE INVENTION

According to the present invention there is provided a collapsible ladder comprising:

- several collapsible ladder sections, each or at least part of the ladder sections comprising two hollow ladder bars arranged parallel to each other and interconnected at an upper end by a rung, and each collapsible ladder section being telescopically inserted into a lower ladder section;
- wherein each ladder bar of a collapsible ladder section has a locking hole adjacent the lower end part of the ladder bar and an extension below the locking hole;
- wherein retaining mechanisms are provided in at least part of the rungs for locking the collapsible ladder sections relative to one another when the collapsible ladder sections are extended, each of or part of said retaining mechanisms comprising a locking pin, which can be brought into an extended and locked position in order to engage a corresponding locking hole provided in the ladder bar of a ladder section positioned there above, and a release part for bringing the locking pin into a retracted and un-locked position; and
- wherein at least part of the rungs holding a retaining mechanism with a locking pin and a release part further have spacers provided at the bottom with at least part of said spacers having a release actuator with a bottom part extending below the spacer when the ladder section above the rung is locked in the extended position, said release actuator engaging the release part of a retaining mechanism of the rung and being arranged to activate the release part when the bottom part of the release actuator is moved upwards through the spacer thereby bringing the locking pin into the un-locked position.

It is preferred that a locking pin is spring biased towards the extended position in order to engage said corresponding locking hole provided in the ladder bar of the ladder section positioned there above.

It is within an embodiment of the invention that the release part of a retaining mechanism comprises a release lever for retracting the locking pin from the locked position into the un-locked position. Here, the release actuator of a rung spacer may extend through the spacer to engage the release lever of the retaining mechanism.

The rung spacers may have a height of at least 20 mm, and the distance between a ladder bar and a rung spacer is at least 80 mm. The release actuator may be at least partly rod-shape.

It is preferred that the rung spacers are hollow with a release actuator extending into the hollow part of a rung spacer. Here, the bottom part of the spacers may form a collar and the release actuator may have a thinner lower part extending through said collar when the ladder section above the rung is locked in the extended position, and the release actuator may have a thicker or shoulder part above the lower part, wherein the thicker or shoulder part is held within the spacer by said collar.

According to an embodiment of the invention the release actuator is spring-biased within the corresponding spacer towards the bottom part of the spacer. Preferably, the release actuator is spring biased towards the inner surface of the spacer collar.

The present invention also covers one or more embodiments, wherein for one or more of the collapsible ladder sections, a non-locking ladder bar slot or groove is formed in the extension of each of the ladder bars and reaching from a distance below the locking hole of the ladder bar to the bottom of the ladder bar. The ladder bar slots or grooves provided in the ladder bar extensions of a corresponding ladder section may have a width and length allowing the ladder section to be fully collapsed while the locking pins locking a ladder section positioned there below pass freely in the ladder bar slots or grooves.

It is preferred that for a collapsible ladder section the distance from the lower side of the rung to the locking hole is smaller than or equal to the similar distance for a ladder section positioned there below, and according to an embodiment the distance from the lower side of a rung to the locking hole is the same for each collapsible ladder section.

According to an embodiment of the invention there is no retaining mechanism in the uppermost rung. It is also within an embodiment of the invention that the ladder bars are formed of circular tubing.

It is preferred that a connector is provided at each end of the rung of a collapsible ladder section for interconnecting the rung with the two ladder bars.

The present invention also covers one or more embodiments, wherein for one or more of the ladder bars having a non-locking ladder bar slot or groove, a plug is provided at the bottom of the ladder bar and reaching into the lower end of the ladder bar, said plug having a plug slot or groove formed therein, which plug slot or groove matches at least part of the slot or groove of the ladder bar.

BRIEF DESCRIPTION OF THE DRAWINGS

FIGS. 4*a*, 4*b* and 4*c* show side and bottom views of a ladder bar with a plug according to an embodiment of the invention, and FIGS. 5*a* and 5*b* show top and side views of an alternative embodiment of a plug to be inserted into a ladder bar according to an embodiment of the invention.

DETAILED DESCRIPTION OF EMBODIMENTS

Figure 1:
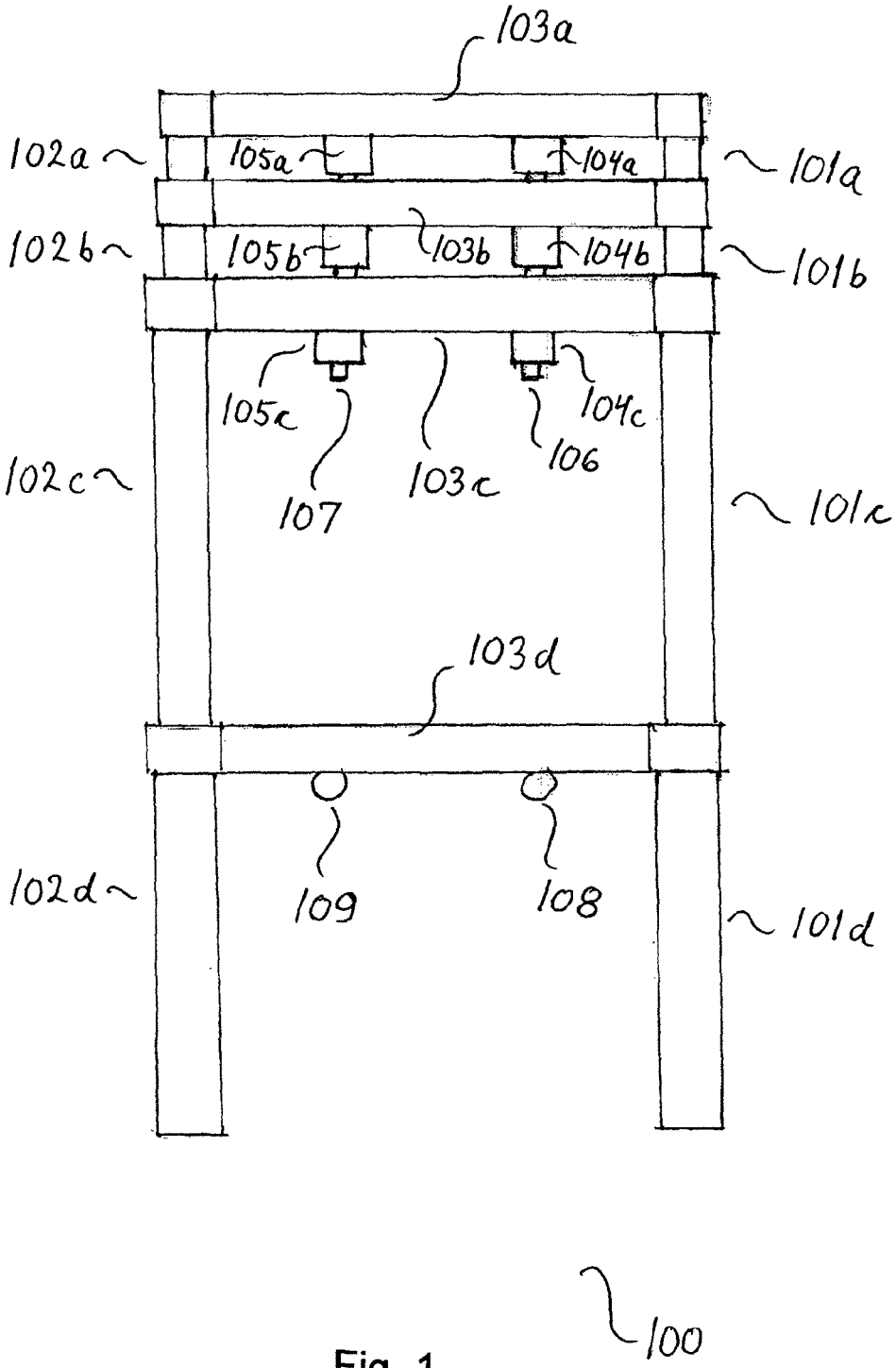
FIG. 1 is a front view of a partly collapsed ladder according to the present invention.

A collapsible ladder according to the invention is illustrated in the drawings. FIG. 1 shows a partly collapsed ladder 100, where the ladder has a number of collapsible ladder sections with hollow ladder bars 101*a,b,c*, 102*a,b,c*, arranged parallel to each other and interconnected at an upper end by a rung 103*a,b,c*. In FIG. 1 the two uppermost ladder sections are collapsed while the third uppermost ladder section is in an extended and locked position. Each collapsible ladder section is telescopically inserted into a lower ladder section. The lowermost ladder section, which is not a collapsible ladder section, also has a rung 103*d* for interconnecting the ladder bars 101*d*, 102*d*. Each rung 103*a,b,c* of the collapsible ladder sections has two spacers 104, 105 provided at the bottom side of the rung 103*a*. The spacers 104, 105 will maintain a safety distance between the rungs 103*a,b,c,d* of the collapsed ladder. In a preferred embodiment the spacers 104, 105 have a height of 25 mm and the distance from a spacer 104 to the ladder bar 101*c* is at least 80 mm. Thus, when this ladder 100 is collapsed, there will be a safety distance between the rungs 103*a,b,c* of 25 mm and a safety distance between the spacers 104, 105 and the ladder bars 101*c*, 102*c* of 80 mm.

The spacers 104, 105 are hollow and release actuators 106, 107 are arranged within the spacers 104, 105. As the release actuators 106, 107 are arranged at the bottom of the spacers 104, 105, then subsequent to activating the release actuators of a lower ladder section, the above ladder sections may automatically be released, whereby the ladder sections collapse, while at the same time keeping a safety distance of 25 mm between the collapsed rungs. The rung 103*d* of the lowermost ladder section has no spacers but has release activating means 108, 109, which may be arranged directly below the rung 103*d*. If the ladder is fully extended, then activation of the release activating means 108, 109 will release the above ladder section, which then collapses and the release actuators 106, 107 hit the upper surface of the rung 103*d*, thereby releasing the next ladder section and so on until the ladder is fully collapsed.

In FIG. 1 the release actuators of the collapsed rungs 103*a*, 103*b* are shown not fully inserted into the spacers, but when collapsed the actuators may well be fully inserted in the spacers.

The release actuators 106, 107 each has a bottom part extending below the spacer 104, 105 when the ladder section above the rung 103*c* is locked in the extended position, as illustrated in FIG. 1.

The principle of operation of locking and un-locking of a collapsible ladder section is described in connection with FIG. 2, which shows part of a cut-through rung 201 according to an embodiment of the invention, which rung 201 in each side end has a retaining mechanism 202 for locking a ladder bar 203 of the above ladder section and a spacer 204 with a release actuator 205. The rung is connected to a ladder bar 218 with the ladder bar 203 being inserted therein.

The ladder bar 203 has a locking hole 206 and the retaining mechanism 202 has a corresponding locking pin 207, which can be brought into an extended and locked position in order to engage the locking hole 206 provided in the ladder bar 203, and the retaining mechanism 202 also has a release lever 208 for bringing the locking pin 207 into a retracted and un-locked position.

The retaining mechanism 202 further comprises a shell 209, being press-fitted into the rung 201, where the shell 209 receives the locking pin 207. The locking pin 207 is displaceably mounted in the shell 209 and is in one end biased by a spring 210. The locking pin 207 is provided with a waist or recess portion 211 in the mid portion of the locking pin 207. The waist or recess portion 211 serves to receive the release lever 208.

The release lever 208 is a rotary button or swivelling lever and may be pivotally mounted with a spindle or pivot 212 to the rung 202, and part of the release lever 208 is a connecting part, which may be forked shaped, and which claps or jams about the waist or recess 211 of the locking pin 207. The release lever 208, which may be roughly L-shaped, has a lower part at least partly extending within a recess 217 of the bottom of the rung 202.

The spacer 204 is mounted to the bottom of the rung 202 and has a hollow part, where the recess 217 extends within an upper opening of the hollow part of the spacer 204. The release actuator 205 is displaceably mounted within the hollow part of the spacer 204, and has a lower or bottom part 213 projecting through a lower opening 214 of the spacer, when the locking pin 207 is in the extended position and engaging the locking hole 206. The upper part 215 is shaped to engage the lower part of the release lever 208 through the recess 217 of the rung 202. The mid portion of the actuator 205 is wider than the lower and upper parts 213, 215 and is formed to steer the actuator when moving up and down inside the spacer 204. Preferably, the actuator 205 is biased by a spring 216 towards the inner surface of the bottom part of the spacer 204.

When extending the ladder section being arranged above the rung 202, then the ladder bar 203 is moved upwards within the ladder bar 218 and the locking hole 206 will reach the position of the locking pin 207, which will be forced into the locking hole 206 by the spring 210, thereby locking the ladder bar 203 and the associated ladder section. During this locking operation, the release lever 208 is rotated about the spindle 212 and the lower part of the lever 208 is lowered or pressed downwards against the release actuator 205, thereby forcing the bottom part 213 of the actuator 205 to project further below the spacer.

When the bottom part 213 of the actuator 205 is pressed upwards, the upper part 215 of the actuator 205 is forced to press the lower part of the lever 208 upwards, thereby rotating the lever about the spindle 212. This rotation brings the connecting part of the lever 208 to push back the locking pin 207 into the shell 209, thereby retracting the locking pin 207 from the engagement with the locking hole 206 bringing the locking pin 207 into the retracted or un-locked position, whereby the ladder bar 203 collapses into the ladder bar 218 connected to the rung 201.

Figure 2:
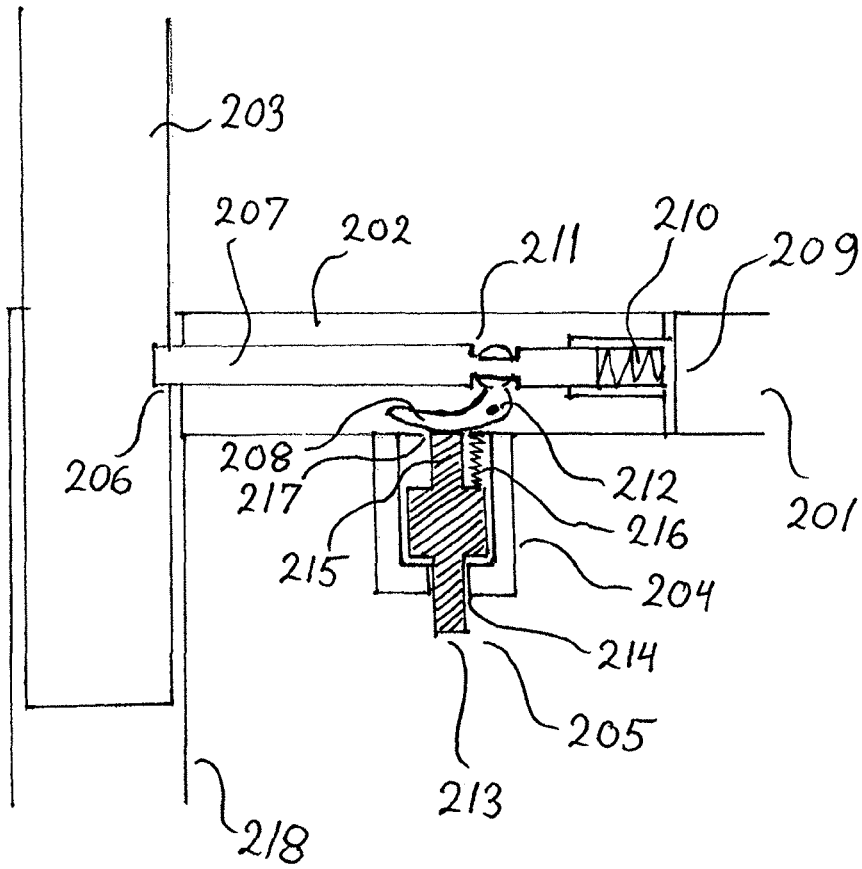
FIG. 2 shows part of a cut-through rung with retaining mechanism for locking the above ladder section and with spacers having a release actuator according to an embodiment of the invention.

Retaining mechanisms operating along the same principles as the retaining mechanism 202 of FIG. 2, but without the spacer 204 and the release actuator 205, have been described in European Patent No. 1843005 B1 and in U.S. Pat. No. 7,316,293 B2, which are both hereby included by reference.

Figures 3A, 3B:
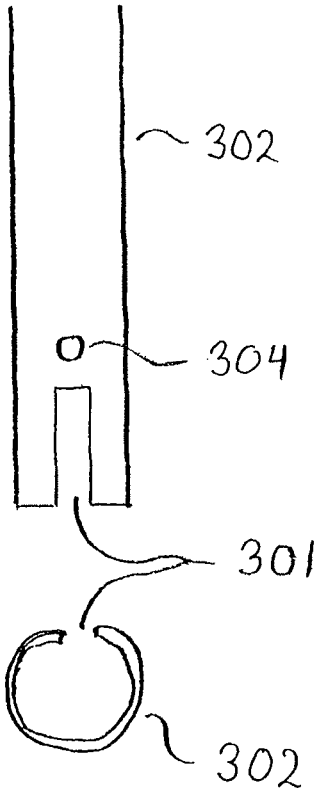
FIGS. 3*a* and 3*b* show side and bottom views of a ladder bar according to an embodiment of the invention.

The invention also covers a collapsible ladder, wherein for one or more of the collapsible ladder sections, a non-locking ladder bar slot or groove is formed in the extension of each of the ladder bars and reaching from a distance below the locking hole of the ladder bar to the bottom of the ladder bar. This is illustrated in FIGS. 3*a* and 3*b*.

Thus, for a ladder section having ladder bars with non-locking ladder bar slots or grooves 301, then the ladder section has two ladder bars 302 connected by a rung with locking holes 304 in each of the ladder bars 302 and a slot or groove 301 in each of the ladder bars 302 below the locking hole 304. The ladder bar slot or groove 301 reaches from the bottom of the ladder bar 302 to a distance below the locking hole 304. As illustrated in FIG. 3*b*, the ladder bars 302 are formed of circular tubing. When the ladder section with the ladder bars 302 is brought into a locked position, the locking pins of the first lower ladder section, 207 of FIG. 2, are engaging the locking holes 304, and when the ladder section with the ladder bars 302 is released by retracting the locking pins from the locking holes 304, then each locking pin of the second lower ladder section, where the second lower ladder section is arranged directly below the first lower ladder section, will be free to extend into a slot or groove 301 allowing the ladder section with the ladder bars 302 to be fully collapsed without resting on the locking pins of the second lower ladder section.

The width and length of the ladder bar slots or grooves 301 shall be dimensioned so as to allow the corresponding ladder section to be fully collapsed while the locking pins of a ladder section positioned therebelow pass freely in the ladder bar slots or grooves 301.

FIGS. 4*a*, 4*b* and 4*c* show side and bottom views of a further embodiment of the invention, wherein a plug or stopper 305 is provided at the bottom of the ladder bar 302, which ladder bar is part of a collapsible ladder section. The plug or stopper 305 may reach into the lower end of the ladder bar 302 to thereby increase the strength of the combination of the ladder bar 302 and plug 305. The plug 305 should have a plug slot or groove 306, which should match the slot or groove 301 of the ladder bar 302.

The plug 305 shown in FIG. 4 is solid, but it is also within the invention that only part of the plug 305 is solid. The plug slot or groove 306 is formed to be deep and wide enough to let a locking pin extending through a locking hole 304 of a ladder bar 302 of a ladder section positioned there below pass freely.

FIGS. 5*a* and 5*b* show top and side views of an alternative embodiment of a plug 505 to be inserted into a ladder bar according to an embodiment of the invention. The plug 505 is partly solid, and almost formed like a wheel with a rim 507 and spokes 508. The bottom part of the plug 505 is provided with a collar or shoulder 509 having a width corresponding to the thickness of the ladder bars. The plug 505 is to be inserted into the lower end of a ladder bar 502 with the collar or shoulder 509 maintaining the plug 505 at the position at the end of the ladder bar 502. The plug 505 also has a plug slot or groove 506, which matches the slot or groove 301 of the ladder bar 302.

Although not shown in the drawings, the present invention also covers embodiments wherein a thin plastic sleeve is covering the outer bottom part of the ladder bars 302 and thereby also covering the bottom part of the plugs 305, 505. Furthermore, the sleeve is formed with a slot or groove to fit into the groove 301 of the ladder bar 302 and the plug slot or groove 306, 506. The sleeve may cover about 1 cm of the lower end of a ladder bar 302.

The invention claimed is:

1. A collapsible ladder comprising:

several collapsible ladder sections, each or at least part of the ladder sections comprising two hollow ladder bars arranged parallel to each other and interconnected at an upper end by a rung, and each collapsible ladder section being telescopically inserted into a lower ladder section;

wherein each ladder bar of a collapsible ladder section has a locking hole adjacent a lower end part of the ladder bar and an extension below the locking hole;

wherein retaining mechanisms are provided in at least part of the rungs for locking the collapsible ladder sections relative to one another when the collapsible ladder sections are extended, each of said retaining mechanisms comprising a locking pin, which can be brought into an extended and locked position in order to engage a corresponding locking hole provided in the ladder bar of a ladder section positioned there above, and a release part for bringing the locking pin into a retracted and un-locked position; and wherein the rungs holding the retaining mechanisms with the locking pins and the release parts further have spacers provided at bottoms of the rungs with said spacers, each spacer having a release actuator with a bottom part extending below the spacer when the ladder section above the rung is locked in the extended position, the release actuator engaging the release part of the retaining mechanism of the rung and being arranged to activate the release part when the bottom part of the release actuator is moved upwards through the spacer thereby bringing the locking pin into the un-locked position.

2. A ladder according to claim 1, wherein the locking pin is spring biased towards the extended position in order to engage said corresponding locking hole provided in the ladder bar of the ladder section positioned there above.

3. The ladder according to claim 1, wherein the release part of the retaining mechanism comprises a release lever for retracting the locking pin from the locked position into the un-locked position.

4. A ladder according to claim 3, wherein the release actuator of the rung spacer extends through the spacer to engage the release lever of the retaining mechanism.

5. A ladder according to claim 1, wherein the rung spacers have a height of at least 20 mm, and wherein the distance between the ladder bar and the rung spacer is at least 80 mm.

6. A ladder according to claim 1, wherein the release actuator is at least partly rod-shaped.

7. A ladder according to claim 1, wherein the rung spacers are hollow with the release actuators extending into the hollow part of the rung spacers.

8. A ladder according to claim 7, wherein the bottom part of each spacer form a collar and the release actuator has a thinner lower part extending through said collar when the ladder section above the rung is locked in the extended position, and the release actuator has a thicker or shoulder part above the lower part, said thicker or shoulder part being held within the spacer by said collar.

9. A ladder according to claim 1, wherein each release actuator is spring-biased within the corresponding spacer towards the bottom part of the spacer.

10. A ladder according to claim 8, wherein the release actuator is spring biased towards the inner surface of the spacer collar.

11. A ladder according to claim 1, wherein for one or more of the collapsible ladder sections, a non-locking ladder bar slot or groove is formed in the extension of each of the ladder bars and reaching from a distance below the locking hole of the ladder bar to the bottom of the ladder bar.

12. A ladder according to claim 11, wherein the ladder bar slots or grooves provided in the ladder bar extensions of a corresponding ladder section have a width and length allowing the ladder section to be fully collapsed while the locking pins locking a ladder section positioned there below pass freely in the ladder bar slots or grooves.

13. A ladder according to claim 11, wherein for a collapsible ladder section a distance from a lower side of the rung to the locking hole is smaller than or equal to a similar distance for a ladder section positioned there below.

14. A ladder according to claim 11, wherein a distance from a lower side of a rung to the locking hole is the same for each collapsible ladder section.

15. A ladder according to claim 1, wherein there is no retaining mechanism in an uppermost rung.

16. A ladder according to claim 1, wherein the ladder bars are formed of circular tubing.

17. A ladder according to claim 1, wherein a connector is provided at each end of the rung of a collapsible ladder section for interconnecting the rung with the two ladder bars.

18. A ladder according to claim 11, wherein for one or more of the ladder bars having the non-locking ladder bar slot or groove, a plug is provided at the bottom of the ladder bar and reaching into a lower end of the ladder bar, said plug having a plug slot or groove formed therein, which plug slot or groove matches at least part of the slot or groove of the ladder bar.

* * * * *